United States Patent [19]

Willhoft

[11] Patent Number: 4,627,244

[45] Date of Patent: Dec. 9, 1986

[54] CRYOGENIC COOLING

[76] Inventor: Edward M. A. Willhoft, 41, Higher Green Epsom, Surrey KT17 3BB, England

[21] Appl. No.: 721,416

[22] Filed: Apr. 9, 1985

[30] Foreign Application Priority Data

Apr. 13, 1984 [GB] United Kingdom ..... 8409692
Feb. 7, 1985 [GB] United Kingdom ..... 8503122

[51] Int. Cl.[4] ..... F25D 13/06

[52] U.S. Cl. ..... 62/63; 62/216; 62/374; 62/380; 73/23; 236/15 E

[58] Field of Search ..... 62/63, 374, 380, 216, 62/222, 223; 73/23; 236/15 E

[56] References Cited

U.S. PATENT DOCUMENTS

| | | | |
|---|---|---|---|
| 3,871,186 | 3/1975 | Wagner | 62/380 |
| 4,142,376 | 3/1979 | Sandberg | 62/223 |
| 4,264,297 | 4/1981 | Van Berkum | 236/15 E |
| 4,276,753 | 7/1981 | Sandberg et al. | 62/380 |
| 4,488,867 | 12/1984 | Beltrami et al. | 236/15 E |

*Primary Examiner*—Ronald C. Capossela
*Attorney, Agent, or Firm*—Fleit, Jacobson, Cohn & Price

[57] ABSTRACT

A process is provided for carrying out the cryogenic cooling of a material which comprises introducing material to be cooled into an elongated cryogenic tunnel housing on means for conveying said material from an inlet end to an outlet end, spraying liquid cryogen onto said material as it travels through said tunnel at a position proximate said outlet end, passing vapor or gas derived from said liquid cryogen in counter-current flow over said material passing through the tunnel, removing from said tunnel at a position proximate said inlet end an exhaust comprising said vapor or gas and atmospheric air entrained thereby through said inlet end, determining the rate of flow of the exhaust and the content of molecular oxygen in said exhaust, and calculating from the rate of flow of the exhaust and its oxygen content the rate of consumption of said liquid cryogen. The rate of consumption of vapor or gas derived from said liquid cryogen can be related to the rate of production of cooled material and the information used to control the operation of the tunnel in order to optimize the weight ratio of liquid cryogen consumed/-cooled material.

6 Claims, 1 Drawing Figure

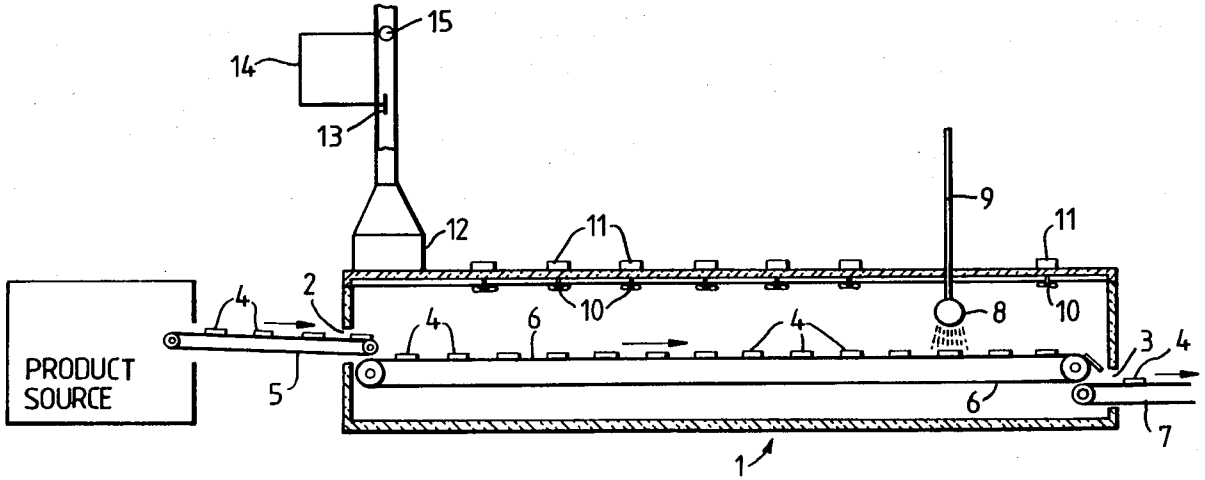
PRODUCT SOURCE
1
2
3
4
5
6
7
8
9
10
11
12
13
14
15

CRYOGENIC COOLING

DESCRIPTION

This invention relates to cryogenic cooling, in particular to apparatus for use in cryogenic cooling and to a process for carrying out cryogenic cooling.

Many materials are frozen or chilled to preserve them. Among such materials are foodstuffs (either processed or raw), drugs, blood and its constituents, and biological specimens. Most such materials are frozen or chilled using blast freezers. However, product damage frequently occurs with mechanical blast freezing. Such damage can be of two types, namely freezer burn and drip loss which manifests itself once a frozen product has been thawed out for direct consumption or cooking. Freezer burn is a consequence of rapid surface dehydration associated with the forced turbulence accompanying blast freezing. Drip loss occurs when a product has been brought down to freezing temperatures slowly. The more rapid a reduction in temperature the less opportunities there are for cell damage due to osmotic effects and minimization of ice crystal size.

It has been generally accepted that initial product quality is better preserved by resorting to cryogenic freezing, using cryogens such as liquid nitrogen and carbon dioxide. The important characteristic of cryogenic freezing is the speed at which a temperature reduction can be achieved, without high turbulence.

During cryogenic freezing, a liquid cryogen is generally sprayed onto a material travelling through an "in-line" tunnel, typically 5 to 25 meters long and 0.75 to 2 meters wide, on a conveyor belt just before its emergence from the tunnel for packing and storage in a cold store. The supply rate of liquid cryogen is usually in response to thermal demand, as determined by the temperature within the cryogenic tunnel. The maximum amount of "cold" is extracted from the liquid cryogen by turbulating, comparatively gently in relation to blast freezing, the vapor or gas derived from the liquid cryogen and passing it, in counter-current flow, over the material passing through the cryogenic tunnel (see for example U.S. Pat. No. 3,871,186, U.S. Pat. No. 4,142,376 and U.S. Pat. No. 4,276,753). Counter-current flow of the gas or vapor precools the material before it is contacted with the liquid cryogen. This avoids damage to the material being cooled if the material is vulnerable to the effects of excessive temperature gradients such as could cause a material to crack or fragment. Not only this, but use of counter-current heat transfer maximizes the effectiveness of the cooling effect achieved by using a liquid cryogen. When using liquid nitrogen as cryogen about 50% of the "cold" is derived from the latent heat of evaporation in going from the liquid phase to the gas phase. Sensible heat becomes available during counter-current gas movement through the cryogenic tunnel. In the case of carbon dioxide cryogen, more than 90% of the "cold" comes from latent heat. Although carbon dioxide cryogen starts as a liquid, stored at high pressures above the critical point and at temperatures close to 0° C. (unlike liquid nitrogen which is stored in vacuum-lined cylinders at about −196° and at lower pressures typically between 1 and 10 atmospheres), it immediately solidifies on being squirted out of spargers into the cryogenic tunnel. The resulting snow largely cools the product by conduction at a temperature of about −78° C. Because of this a cryogenic tunnel employing carbon dioxide as cryogen does not require counter-current chilling.

In order to improve the thermal efficiency of a tunnel, liquid cryogen that has not vaporised upon contact with the material being cooled can be collected from below a conveyor and recirculated, optionally with relatively cold vapor or gas that has not released its "cold" and, being denser than vapor or gas that has been fully utilised in cooling the material, tends to settle at the lower levels of the tunnel, below the conveyor.

Whether with or without counter-current heat transfer, it is important, for safety reasons, to guide the effluent gases out of the tunnel and to the external atmosphere, that is outside the factory environment. If this were not to be done, the oxygen content in the factory environment would be reduced with possible adverse consequences upon factory personnel, including anoxia. It has been conventional in the past not to monitor the effluent gases.

The performance of a cryogenic tunnel can be expressed in terms of the weight ratio of the liquid cryogen used to the product. In the most favourable cases the ratio can be as low as 0.7:1, depending upon the product and largely being affected by the water content. In other words, for this ratio, 0.7 kg of liquid nitrogen is required to freeze 1 kg of product. In a freezing operation, the consumption of the liquid cryogen largely determines the cost of freezing or chilling and during performance it is desirable to have information available that will make it possible to maintain the liquid cryogen used/product ratio as small as possible, consistent with optimal freezing from the point of view of quality and temperature.

In principle, it should be possible to monitor the consumption of liquid cryogen gravimetrically by placing a load cell under the storage tank for the liquid cryogen. However, the considerable weight of the tank and its contents make it difficult to obtain accurate consumption figures for less than a single day's production, and this mitigates against continuous information being made available during a production run with a view to controlling the performance of the cryogenic tunnel. Also, in principle, it should be possible to monitor the consumption of liquid cryogen by monitoring the rate of flow of the cryogen, but in practice this is very difficult since it entails measuring the flow of an intensely cold liquid at its boiling point. In other words, accurate measurement would require phase separation which, for a rapidly boiling liquid, is difficult to achieve. Another approach to determining the rate of consumption of a liquid cryogen under operating conditions would be to concentrate on measuring the absolute gas flow of the spent gases ducted to the outside atmosphere. This approach could be appropriate where the formation of snow or frost does not occur in the exhaust duct by virtue of the high efficiency of the tunnel (the higher the spent gas temperature the better is the performance of the tunnel since, clearly, more "cold" has been given up by the liquid cryogen to the product being cooled). Another problem with this approach is the dilution of the spent cryogen with atmospheric air entering the tunnel with the product.

The present invention seeks to monitor a cryogenic operation, with a view to providing the basis for a totally computer-controlled method of cooling, as by freezing or chilling. In accordance with the invention the rate of consumption of gas, derived from the liquid cryogen, is determined, so that once the rate of production of frozen product is known (this can be determined as mentioned above gravimetrically, for example by placing a weight-sensitive conveyor immediately before the tunnel entrance as is frequently done in "in-line" check weighing or by measuring the weight of frozen product directly after it has left a tunnel), the weight ratio of liquid cryogen consumed/product can readily be calculated from the process data. The information can be fed into a micro-processor or in-line computer, the former ultimately for setting up control loops for automatic operation and the latter for monitoring remotely, if desirable or necessary.

BRIEF DESCRIPTION OF THE DRAWING

The FIGURE is a schematic representation of a cryogenic tunnel embodying the teachings of the invention.

DETAILED DESCRIPTION OF THE PREFERRED EMBODIMENT

According to the invention there is provided a process for carrying out the cryogenic cooling of a material which comprises introducing material to be cooled into an elongated cryogenic tunnel housing on means for conveying said material from an inlet end to an outlet end, spraying liquid cryogen, preferably liquid nitrogen, onto said material as it travels through said tunnel at a position proximate said outlet end, passing vapor or gas derived from said liquid cryogen in counter-current flow over said material passing through the tunnel, removing from said tunnel at a position proximate said inlet end an exhaust comprising said vapor or gas and atmospheric air entrained thereby through said inlet end, determining the rate of flow of the exhaust and the content of molecular oxygen in said exhaust, and calculating from the rate of flow of the exhaust and its oxygen content the rate of consumption of said liquid cryogen.

The cryogenic tunnel is generally indicated as 1, and is provided with an inlet end 2 and an outlet end 3. Material to be cooled 4 passes from a product source on an input conveyor 5 through inlet end 2 and onto a tunnel conveyor belt 6 which transports it from inlet end 2 to outlet end 3, where it is discharged, having been cooled, onto a take-away conveyor 7. Liquid cryogen is sprayed from header 8 onto material 4 passing through the tunnel 1. Liquid cryogen is supplied through conduit 9 to spray header 8 from a supply of liquid cryogen (not shown). The tunnel 1 is provided with a series of fans 10, driven by motors 11, to ensure efficient circulation of vapor or gas derived from the liquid cryogen. Exhaust 12 is provided to withdraw from the tunnel 1, at a position proximate to the inlet end 2, spent vapor or gas derived from the liquid cryogen. In accordance with the present invention the exhaust 12 is provided with means, generally indicated as 13, for determining the rate of flow of the exhaust gases or vapors and the content of molecular oxygen therein. Means 13 suitably comprise an oxygen probe, anemometer and thermometer. Means 13 are connected, as by a control loop 14, to an exhaust fan 15 whereby the operation of the tunnel 1 can be controlled. Control can be achieved, for example, by varying the speed of extracting of an exhaust gas mixture from the tunnel, as by altering the speed of an exhaust fan or by altering the size of an exhaust aperture. Alternatively, operation of the tunnel 1 can be controlled by varying the amount of air entrained in the exhaust gases through the inlet end 2 of the tunnel 1.

Preferably the rate of consumption of vapor or gas derived from said liquid cryogen is related to the rate of production of cooled material and the information used to control the operation of the tunnel in order to optimize the weight ratio of liquid cryogen consumed/-cooled material.

The absolute gas flow through an exhaust duct can be calculated from a knowledge of its concentration (if a mixture of gases is passing through the duct), temperature and apparent rate of flow. The apparent rate of flow of gas can be measured using an anemometer or similar device. This preferably should not be of the hot-wire type in order to keep the system as simple as possible, and a suitable type is a vane, spinning head instrument or vortex-shedding meter. If the exhaust from a tunnel were exclusively derived from cryogen, say molecular nitrogen, in other words no atmospheric gas had become entrained, then by combining the apparent flow rate with a temperature measuring device such as a thermocouple and pressure-measuring device such as an absolute pressure gauge, simple calculations would make possible an assessment of the amount of cryogen that had been consumed. In practice, however, some entrainment of atmospheric air always occurs. This is either deliberate (in order to prevent frosting up of the exhaust duct by reducing the temperature of the exhaust) or unintentional. With entrainment, the composition of the gases discharged through the exhaust duct needs to be determined in order to obtain a meaningful figure for the rate of consumption of the cryogen.

It is difficult to monitor, in-line, the nitrogen content of a mixture of gases because of the chemical inertness of nitrogen. The same does not apply to oxygen, the content of which is approximately constant in atmospheric air. By determining the departure in the oxygen content of the exhaust gases from a cryogenic tunnel from the oxygen content in the ambient atmospheric air, the gas content derived from a liquid cryogen can be quantified. Assuming an oxygen content of 21% by volume (more accurately 20.8% by volume) in the ambient atmospheric air, the greater the reduction from 21% of the oxygen content in the exhaust gases from a cryogenic tunnel, the less air has been entrained into the tunnel. Once the amount of entrained air has been assessed, from the oxygen content in the exhaust gases, it is a relatively simple matter to calculate the rate at which gases derived by the vaporization of a liquid cryogen are passing through the tunnel.

While it is possible to assume a constant oxygen level in the ambient atmospheric air and still obtain reasonably accurate results, it is also possible to monitor the oxygen content in the ambient atmospheric air, but more preferably in the air at the inlet end of the tunnel, simultaneously with the measurement of the oxygen content in the exhaust gases. The oxygen content in the ambient atmospheric air, if desired, and in the exhaust gases can be measured using commercially available oxygen-measuring probes. The data, that is oxygen levels in ambient atmosphere and exhaust gases, voltage measurement from the thermocouple or similar device for determining the temperature of the exhaust gases, measured gas flow rate, absolute pressure and product freezing rate can, if desired, be fed into a computer or micro-processor to display, remotely such as in a factory manager's office, the performance level of the cryogenic freezing tunnel or to control the operation of the tunnel. If desired, other useful in-line parameters, such as external product temperatures both before and immediately during and after freezing, can also be monitored.

In addition to optimising the liquid cryogen used/product ratio it is desirable to achieve substantially quantitative removal of cryogen gas from a cryogenic tunnel. There are various reasons for seeking quantitative removal of cryogen gas, including safety, accuracy in deriving a liquid cryogen used/product ratio and economic functioning of the cryogenic equipment.

In accordance with the present invention there is also provided a method for continuously adjusting and controlling the extraction of cryogen gas through the exhaust duct of a cryogenic apparatus, thus to ensure substantially quantitative removal of the cryogen gas to the outside atmosphere and to maximise utilisation of the cryogen, by monitoring the analytical composition of a mixture of exhaust gases from the cryogenic apparatus and relating the analytical composition of said mixture, as by the formation of a control loop, to the rate of extraction of the gas or vapor derived from the liquid cryogen. The rate of extraction of cryogen gas can be varied, for example, by varying the speed of extraction of the mixture of exhaust gases from the cryogenic apparatus, as by an exhaust fan or other suitable means, and/or by varying the amount of air entrained through the inlet end of the tunnel, as by varying the position of an exhaust gas inlet. This embodiment of the present invention provides a further control aspect in cryogenic freezing since the extraction rate of a cryogenic gas, which can constantly vary, is continuously linked with the extent of dilution of cryogen gas in an exhaust duct with atmospheric air, the atmospheric air being introduced either deliberately (in order to prevent frosting up of an exhaust duct), or by entrainment with product to be frozen.

A liquid nitrogen consumption rate (LNC) can be represented by the formula:

$$LNC = \frac{K(OA - OD)F.P.}{T.OA}$$

where K is a derivable constant, F is the measured flow rate of gases in the exhaust duct at a temperature of T° Kelvin, OA is the oxygen concentration in the atmosphere, OD is the absolute oxygen concentration in the exhaust duct and P is the pressure relative to the standard atmosphere (101.325 kPa or 760 mm Hg).

By linking the value of OD to the speed of an exhaust fan (or some other gas extraction control system which can, for example, include an aperture of variable dimensions controlling cold gas intake to an exhaust duct) it is possible to automate a cryogenic process in such a way as to ensure a substantially quantitative removal of a cryogen gas, the amount of which cryogen gas can vary during the cryogenic process.

There is no particular restriction on the manner of measuring the various physical parameters outlined, with the use of a wide variety of measuring equipment being possible in accordance with the present invention.

An apparatus in accordance with the invention can thus comprise a cryogenic tunnel; means for passing a material to be cryogenically cooled through said tunnel; means for supplying a liquid cryogen to said tunnel whereby vaporization of said liquid cools material passing through the tunnel; means for measuring the flow of exhaust gas exiting said tunnel; means for measuring the temperature and pressure of the exhaust gas exiting said tunnel; means for determining the oxygen content of exhaust gas exiting said tunnel; optional means for determining the oxygen content of the atmosphere surrounding the cryogenic tunnel; and means for determining or monitoring the rate at which material passes through the tunnel.

The present invention is based upon an analysis of exhaust gases in which the oxygen content of the exhaust gases is determined using an oxygen probe. It should be realised, however, that other methods might be employed. For example, a gas chromatograph or mass spectrometer could be used. Another possible physical measurement of exhaust gas composition, or even flow rate, involves infra-red analysis of the exhaust gases.

I claim:

1. A process for carrying out the cryogenic cooling of a material which comprises introducing material to be cooled into an elongated cryogenic tunnel housing on means for conveying said material from an inlet end to an outlet end, spraying liquid cryogen onto said material as it travels through said tunnel at a position proximate said outlet end, passing vapor or gas derived from said liquid cryogen in counter-current flow over said material passing through the tunnel, removing from said tunnel at a position proximate said inlet end an exhaust comprising said vapor or gas and atmospheric air entrained thereby through said inlet end, determining the rate of flow of the exhaust and the content of molecular oxygen in said exhaust, calculating from the rate of flow of the exhaust and its oxygen content the rate of consumption of said liquid cryogen, relating the rate of consumption of said liquid cryogen to the rate of production of cooled material and controlling the operation of the tunnel to optimize the weight ratio of liquid cryogen consumed/cooled material.

2. A process according to claim 1 wherein the rate of flow of the exhaust is determined by pressure, temperature and anenometric measurements.

3. A process according to claim 1, wherein the liquid cryogen is liquid nitrogen.

4. A process according to claim 1, wherein the oxygen content in the air at the inlet end of the tunnel is determined simultaneously with the content of molecular oxygen in the exhaust.

5. A process according to claim 1 wherein the analytical composition of the exhaust is monitored and related to the rate of extraction of gas or vapor derived from the liquid cryogen, thereby to ensure substantially complete removal of used cryogen from the tunnel.

6. Appatatus for use in the cryogenic cooling of a material, said apparatus comprises a cryogenic tunnel; means for passing a material to be cryogenically cooled through said tunnel; means for supplying a liquid cryogen to said tunnel whereby vaporization of said liquid cools material passing through the tunnel; means for measuring the flow of exhaust gas exiting said tunnel; means for measuring the temperature end pressure of the exhaust gas exiting said tunnel; means for determining the oxygen content of exhaust gas exiting said tunnel; and means for controlling the operation of the tunnel to optimize the weight ratio of liquid cryogen consumed/cooled material.

* * * * *